United States Patent [19]

Kardon

[11] Patent Number: 4,464,158

[45] Date of Patent: Aug. 7, 1984

[54] METHOD OF MAKING TAMPERPROOF BAG CLOSURE

[76] Inventor: Donald R. Kardon, 134 N. Narberth Ave., Narberth, Pa. 19072

[21] Appl. No.: 372,308

[22] Filed: Apr. 27, 1982

[51] Int. Cl.[3] ..... B31B 1/62

[52] U.S. Cl. ..... 493/265; 493/330; 493/331

[58] Field of Search ..... 493/265, 264, 330, 331, 493/332; 264/4; 428/321.5, 402

[56] References Cited

U.S. PATENT DOCUMENTS

| | | | |
|---|---|---|---|
| 2,046,975 | 7/1936 | Shaw et al. | 493/330 X |
| 2,248,255 | 7/1941 | Staude | 493/330 X |
| 3,875,074 | 4/1975 | Vassiliades et al. | 264/4 X |
| 3,886,084 | 5/1975 | Vassiliades | 264/4 X |
| 4,134,322 | 1/1979 | Lillibridge | 493/265 X |

FOREIGN PATENT DOCUMENTS

| | | | |
|---|---|---|---|
| 2620418 | 11/1977 | Fed. Rep. of Germany | 493/265 |

*Primary Examiner*—James F. Coan

*Attorney, Agent, or Firm*—Joseph W. Molasky & Assocs.

[57] ABSTRACT

A tamperproof bag is provided with closure means comprising a strip of microcapsules containing an adhesive core enclosed by a shell adapted to be broken by pressure application to release the adhesive contents. The microcapsules are applied to the bag by means of a binder system or by depositing them onto an adhesive tie-coat previously applied to the bag.

8 Claims, 5 Drawing Figures

FIG. 1
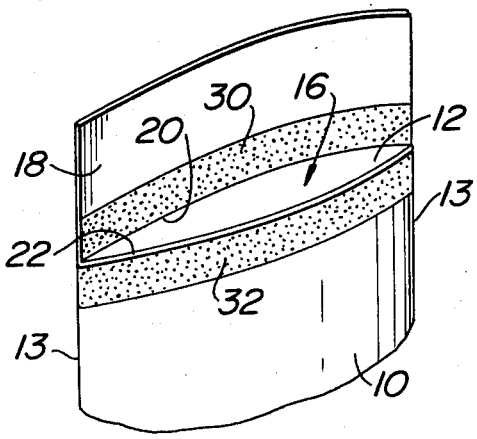
FIG. 2
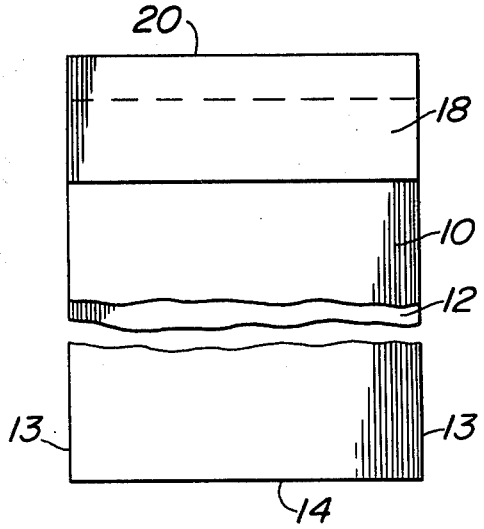
FIG. 3
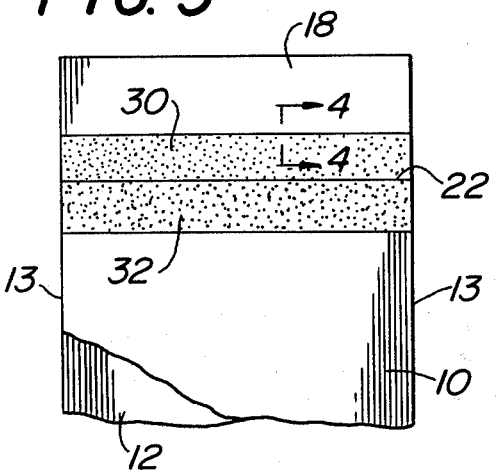
FIG. 4
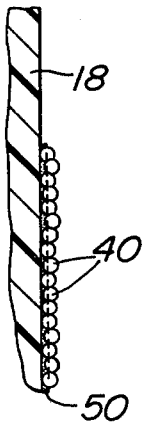
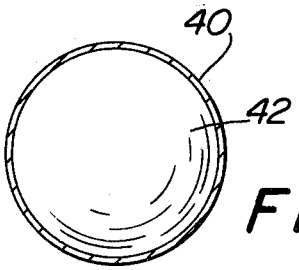
FIG. 5

METHOD OF MAKING TAMPERPROOF BAG CLOSURE

BACKGROUND AND SUMMARY OF THE INVENTION

This invention relates generally to closure means for bags and more particularly to a closure means for a tamperproof bag. Tamperproof bags are used in various applications such as, for example, bank deposit bags, police evidence bags, and prescription containing bags in hospitals. Tamperproof bags of the indicated type must provide a secure closure of the bag opening to resist reopening of the bag once it is closed and the closure must be capable of revealing any tampering with or attempts to reopen the bag.

Present-day tamperproof bags are not entirely satisfactory since they are generally too expensive and are not completely tamperproof. For example, one common tamperproof bag in use today comprises a plastic bag closed at one end and have a flap adapted to be folded over an open end. A first adhesive tape is adhered to the inside wall of the flap and a second adhesive tape is adhered to the bag area adjacent the opening. Each of these tapes is provided with a protective liner which must be removed prior to adhering the flap into the closed position. This type of construction is expensive and involves difficult manufacturing techniques in applying the adhesive tapes to the bag.

In accordance with the invention there is provided a novel means for closing a bag of the indicated type. The bag closure of the invention comprises a strip of microcapsules which are applied as a band along an area of the inside surface of a flap and along an area of the outside surface of the end of a bag wall adjacent the bag opening. The microcapsules contain an adhesive core enclosed by a non-adhesive shell adapted to be broken upon the application of pressure thereto to release the adhesive contents which serves to seal the flap onto the bag wall in the bag closing position.

In accordance with the invention there are provided two methods for applying the microcapsules to the appropriate areas of the bag. In accordance with one method a dispersion of the microcapsules in a binder system is coated onto the bag and the binder system is dried to drive off non-active binder ingredients leaving the microcapsules adhering to the bag. In accordance with another method of the invention, an adhesive tie-coat is applied to the bag and the microcapsules are then dusted onto the adhesive, after which excess microcapsules are removed, as by vacuum or another suitable method.

BRIEF DESCRIPTION OF THE DRAWINGS

FIG. 1 is a view of a bag in accordance with the invention in an open position.

FIG. 2 is a view showing the bag of FIG. 1 in a closed position.

FIG. 3 is a fragmentary plan view showing the top end of the bag of FIG. 1.

FIG. 4 is a section taken on line 4—4 of FIG. 3 in an enlarged scale.

FIG. 5 is a sectional view of a microcapsule in an enlarged scale.

DETAILED DESCRIPTION OF THE PREFERRED EMBODIMENT

The tamperproof bag in accordance with the invention preferably comprises a plastic bag having a pair of side walls 10 and 12 closed at their side edges 13 and at their bottom end 14 and provided with an opening 16 at their top end. The bag is preferably made of a suitable plastic (synthetic resin) such as, for example, a polyalkylene such as polyethylene or polypropylene and the like. Side wall 12 has a flap 18 extending therefrom and adapted to be folded over along a fold line 20 aligned approximately with the top edge 22 of side wall 10. Fold line 20 and top edge 22 extend around the periphery of opening 16 of the bag. By this construction, the flap 18 can be folded over along the fold line 20 to place the inside surface thereof in contact with the top portion of the outer surface of the side wall 10 to close the opening 16. This condition of the bag is shown in FIG. 2.

In accordance with the invention novel means are provided for securing the flap 18 in its folded over or bag closure position.

To this end, a band of microcapsules are deposited to cover an area 30 on the inside surface of the flap 18 and an area 32 on the outside surface of the side wall 10. As is shown in FIGS. 1 and 3, area 30 extends along opening 16 in a region above fold line 20 and area 32 extends along opening 16 in a region below top edge 22. By this arrangement, areas 30 and 32 are located to cover the bag opening 16 and to provide a sealed closure for the bag opening 16 when the flap 18 is folded over and pressed into contact with the bag side wall 10 in the closed position shown in FIG. 2.

The microcapsules are very small particles that are spherical in shape as shown in FIG. 5 and are made by microencapsulation techniques well known in the art. Microencapsulation is a micropackaging process involving the deposition of thin polymeric coatings to minute particles by employing coacervation (phase separation). These capsules are small enough to be handled as a powder and comprise a shell 40 enclosing a core 42. Typically the core 42 would comprise 95% of the mass of the capsule. In accordance with the present invention, the core 42 consists of a suitable adhesive and the shell 40 is non-adhesive and adapted to be broken on the application of pressure thereto to release the adhesive contents thereof which, in the present application, serves to secure the bag flap 14 to the outside surface of the side wall 10 to close the bag opening 16.

Suitable adhesives for use in the core 42 of the microcapsules are (1) hot-melt, the main ingredient of which is a styrene polyisoprene blocked co-polymer or other similar hot-melts, (2) a polymer material which, when the capsule is broken, spreads and sets up like "Elmer's Glue", the water or solvent carrier evaporating to leave a structural or permanent system, and (3) an epoxy system. These adhesive chemicals are well known in the art.

The shell 40 of the microcapsules is made of a non-adhesive composition such as a cross-linked polymer. The thickness of the microcapsules in accordance with the invention may range from 2–2000 microns, although the thickness is preferably from about 2–300 microns, which size is larger than thickness of the coating 50 used to adhere them to the bag, as shown in FIG. 4.

In accordance with the invention, the microcapsules are applied to the bag along the areas 30 and 32 as a single band which encompasses these areas as is best shown in FIG. 3.

A first method of applying the microcapsules to the bag comprises the initial step of dispersing the capsules in a binder matrix to form a slurry. This slurry is deposited onto the areas 30 and 32 of the bag. The binder matrix can be a water or solvent-based system which holds the capsules in the matrix and when applied to the areas of the bag, holds the capsules to the bag. The next step in this method is to evaporate or dry the binder matrix to drive off the solvents or water thereof to leave the microcapsules adhered to the plastic bag.

A second method of applying the microcapsules to the bag includes the initial step of applying a tie-coat adhesive system to the areas 30 and 32 of the bag. This tie-coat can be either hot-melt, solvent or water based adhesive primer. The tie-coat is partially dried or allowed to evaporate. The next step in this method is to apply a powder of the microcapsules onto the tie-coat adhesive system on areas 30 and 32 as by dusting or brushing them onto the adhesive system. During this procedure, a portion of the applied microcapsules will not adhere to the adhesive system. The final step in this method is to remove the excess microcapsules from the areas 30 and 32 by vacuuming them off.

The condition of the microcapsules after they have been applied to the bag and prior to a closing operation is illustrated in FIG. 4. It will be noted that the microcapsules are of a size which is larger than the adhering coating 50. By this arrangement, the microcapsules will project outwardly from the coating 50 so that they will prevent contact with the adhesive coating 50 and so that they can be broken upon the application of pressure during a bag closing procedure.

In the use of the tamperproof bag in accordance with the invention, the bag will normally be maintained in the open position shown in FIG. 1. In this condition, the non-adhesive shells of microcapsules insure that the areas 30 and 32 are non-sticking. When it is desired to seal the bag opening 16, the flap 18 is folded over along the fold line 20 to place the areas 30 and 32 into overlapped relation and pressure is applied along the bag from the outside to press the areas 30 and 32 together. This application of pressure causes the microcapsules to break to thereby release the adhesive contents thereof. The released adhesive secures the areas 30 and 32 together in a tightly sealed condition. This sealed condition of the bag provides a very tight seal and one that is tamperproof. Moreover, this has been achieved by a very inexpensive construction and one that can be produced by simple manufacturing techniques.

I claim:

1. A method of applying a tamperproof bag closure means to a bag having a pair of side walls providing an opening at one end and a flap extending from one side wall adapted to be folded over from said side wall along a fold line to overlap the outside of the other side wall to enclose the bag opening with a tamperproof closure, comprising the steps of:

(1) depositing in one application a single band of a powder of microcapsules in a binder system onto the inside surface of the bag flap and onto a portion of the outside surface of the other side wall in areas that are in overlapping relation when the flap is folded along said fold line onto the other side wall to enclose the bag opening, said band area on the bag flap and other side wall being on both sides of said fold line and completely enclosing the bag opening to provide a tamperproof bag closure condition when the bag flap is folded over along said fold line to place said band areas in contact, said microcapsules containing an adhesive core enclosed by a non-adhesive shell, (2) and drying said binder system to drive off binder ingredients so as to leave the microcapsules adhered to the bag.

2. A method according to claim 1 wherein said microcapsules are of a size of about 2–2000 microns and the thickness of the adhesive coating is less than the size of the microcapsules.

3. A method of applying a tamperproof bag closure means to a bag having a side walls providing an opening at one end having a flap adapted to be folded over from one side wall along a fold line onto an outer surface of the other side wall to overlap the same and enclose the bag opening with a tamperproof closure, comprising the steps of:

(1) applying an adhesive to the bag along a single band including an area of an inside surface of the bag flap and an area on the outside surface of the side wall that is overlapped by said flap when said flap is folded along said fold line onto said other side wall to close the bag opening, said band area on the bag flap and other side wall being on both sides of said fold line and completely enclosing the bag opening to provide a tamperproof bag closure condition when the bag flap is folded over along said fold line to place said band area in contact, (2) applying a powder of microcapsules onto said adhesive coating, said microcapsules containing an adhesive core enclosed by a non-adhesive shell adapted to be broken upon the application of pressure thereto to release the adhesive contents, and (3) removing the excess non-adhered microcapsules from said adhesive coating.

4. A method according to claim 3 wherein the size of said microcapsules is about 2–2000 microns and the thickness of said adhesive coating is less than the size of the microcapsules.

5. A method according to claim 3 wherein the step of removing the excess microcapsules is performed by applying a vacuum to said band to pick up the loose microcapsules therefrom.

6. A method according to claim 3 wherein said adhesive core of said microcapsules comprises a hot-melt pressure sensitive system the main ingredient of which is a styrene polyisoprene blocked co-polymer.

7. A method according to claim 3 wherein said adhesive core of said microcapsules comprises a polymer material.

8. A method according to claim 3 wherein said adhesive core of said microcapsules comprises an epoxy material.

* * * * *